United States Patent [19]

Kühn

[11] Patent Number: 4,508,501

[45] Date of Patent: Apr. 2, 1985

[54] METHOD OF MONITORING FURNACE INSTALLATIONS

[75] Inventor: Friedhelm Kühn, Mülheim, Fed. Rep. of Germany

[73] Assignee: Ruhrgas Aktiengesellschaft, Essen, Fed. Rep. of Germany

[21] Appl. No.: 473,370

[22] Filed: Mar. 8, 1983

[30] Foreign Application Priority Data

Mar. 11, 1982 [DE] Fed. Rep. of Germany ..... 3208765

[51] Int. Cl.[3] ..... F23N 5/00

[52] U.S. Cl. ..... 431/2; 431/15; 431/76; 126/91 A; 236/15 E

[58] Field of Search ..... 431/2, 15, 76; 126/91 A; 236/15 E; 432/23, 37

[56] References Cited

U.S. PATENT DOCUMENTS 2,255,540 9/1941 Dreffein ..... 126/91 A 4,116,612 9/1978 Melgaard ..... 431/76

4,406,611 9/1983 Michel ..... 431/76

FOREIGN PATENT DOCUMENTS 125541 9/1979 Japan ..... 431/76

*Primary Examiner*—Carroll B. Dority, Jr.

[57] ABSTRACT

A process for the surveillance of jacketed radiant heating tubes and recuperative burners using a detector responding to the oxygen partial pressure in the exhaust gas. At low exhaust gas temperatures down to 200° to 300° C., an abrupt change in the detector output signal occurring due to the transition from over-stoichiometric to under-stoichiometric combustion and vice-versa is detected and is reproduced as an actuating and/or alarm signal. The process can also be used for flame surveillance, for the determination of leaks and cracks in jackets, and for surveillance of the tightness of closed magnetic gas valves.

6 Claims, 2 Drawing Figures

METHOD OF MONITORING FURNACE INSTALLATIONS

BACKGROUND OF THE INVENTION

1. Field of the Invention

The invention relates to the field of the control of the operation of burner systems, especially safety control of jacketed radiant heating tubes, using a detector responding to the oxygen gas partial pressure in the exhaust gas.

2. State of the Art

In known systems, the air number is determined by the quantitative measurement of the oxygen partial pressure in the exhaust gas and, by controlling the oven or the feed of gas and air accordingly, the system is regulated at a given constant level. In this manner the quality of combustion can be monitored and kept constant. This known use of a detector responding to oxygen partial pressure in the exhaust gas as a means of measurement for the continuous regulation of combustion quality requires that the exhaust gas temperatures be within a relatively high temperature range of 500° to 600° C. At lower exhaust gas temperatures the sensor is suitable for quantitative measurement of the oxygen partial pressure only if it is heated accordingly.

In burner systems for industrial ovens, especially those intended for heat treatment in the steel industry, relatively low exhaust gas temperatures are desired. In recent times preference has been given to using the exhaust gas for preheating the combustion air. This is done, for example, in jacketed radiant heating tubes and recuperative burners. In combustion apparatus of this kind, continuous monitoring of the exhaust gas has not been performed heretofore. Exhaust gas analyzers are too expensive for such monitoring, and also they are slow-acting. The use of heated detectors in each burner is also too expensive. Without constant monitoring of the conditions of combustion, however, a transition from excess air to insufficient air, for example, goes undetected. The result is that, when the burner is operating under unfavorable combustion conditions, expensive repairs, such as the replacement of recuperative burners or jacketed radiant heating tubes or other successive recuperators, may become necessary, even if the burner system is given periodic maintenance and inspection. As it will be seen, the process of the invention permits a simple and constant monitoring of conditions of combustion even at low exhaust gas temperatures, e.g., in the use of recuperative burners or jacketed radiant heating tubes.

A special problem has been the leakage of a magnetic valve which serves for shutting off the gas feed line to a radiant heating tube. If a leak occurs in a magnetic gas valve, the as a rule unburned gas is let into the exhaust gas system. This cannot be tolerated. It has therefore been necessary for reasons of safety to provide double shut-off valves equipped with a blow-off means. Such an installation is extraordinarily expensive. The invention makes it possible, without additional instrumentation costs, to have continuous surveillance of the tightness with which a magnetic valve shuts off the gas feed line and to provide for an alarm to be given if leaks are detected. On the basis of the warning signal, a hand-operated shut-off valve can then be closed immediately.

Another trouble which can occur in the use of jacketed radiant heating tubes is a crack in the jacket. In this case the oxygen in the exhaust gas diffuses into the oven which is filled with inert gas. The consequence is oxidation of the material being heat treated in the oven. Heretofore it has been possible to locate the damaged radiant heating tube only by shutting off the system and individually pressure-testing the tubes. However, not only does oxygen escape through a crack in the jacket, but also, on account of the drop in the partial pressure, gases such as hydrogen, and hydrocarbons, also diffuse from without into the jacket and thus into the exhaust gas system. As it will be seen, this diffusion and possible inflow of inert and reactive gases into a jacketed radiant heating tube can be detected throughout the time of operation. When a defective jacketed radiant heating tube is detected, all of the connected media inputs and outputs are immediately shut off.

BRIEF SUMMARY OF THE INVENTION

A process is described for the monitoring of combustion apparatus which are operated at low exhaust gas temperatures with preheating of air. A measuring sensor responding to the oxygen partial pressure in the exhaust gas is inserted into the exhaust gas flue behind the recuperative burner or jacketed radiant heating tube. At the low exhaust gas temperatures down to 200° to 300° C. which are there encountered, an abrupt change in the detector output signal caused by the transition from over-stoichiometric to under-stoichiometric combustion and vice versa is detected and an alarm signal and/or an actuating signal for shutting off at least the magnetic gas valve is produced on the basis of such an abrupt change.

It is known that detectors responding to oxygen partial pressure in the exhaust gas, when used at high exhaust gas temperatures of, for example, 500° to 600° C., have an operating characteristic curve that has this sort of abrupt change. It has been found that this abrupt change can be unmistakably detected even when low exhaust gas temperatures make the characteristic curve unsteady, i.e., when the conventional method of quantitative determination of the oxygen partial pressure is impossible. The abrupt change in the detector output signal indicates that the combustion has shifted from excess air to insufficient air. Accordingly immediate servicing of the burner system is necessary. By the emission of an actuating signal to shut off the gas feed, and other media inputs and outputs if desired, continued operation of the burner system under undesirable combustion conditions can be prevented. By means of a warning signal, the operating personnel can, as an alternative, provide for manual shut-down and immediate service of the burner system. In the case of radiant heating tubes, a safety circuit is provided which consists of a magnetic valve and a mechanical position detector which confirms that the magnetic valve in the gas feed line is in its end positions. Comparing the output signal of the detector with a predetermined bottom limit will show when the solenoid valve in the gas feed line is leaking gas in the shut-off state.

By means of the oxygen partial pressure detector, a constant monitoring of the flame can also be performed. If no combustion takes place when the gas feed is opened, the output signal from the detector will definitely be outside of the range prescribed for normal combustion. Under this condition, an actuating signal will automatically be produced, which will shut off the feed of gas to the radiant heating tube.

DETAILED DESCRIPTION OF THE INVENTION

Figure 1:
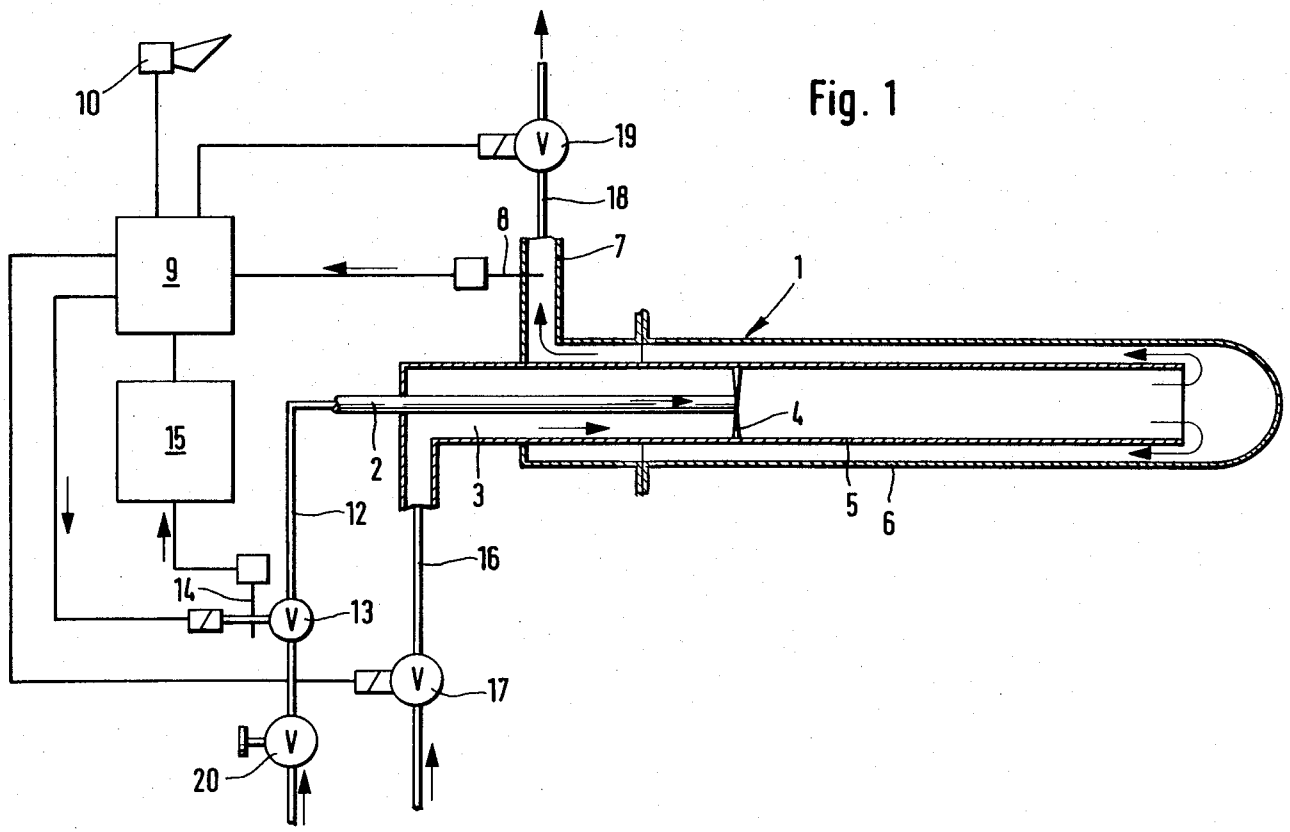
FIG. 1 is a diagrammatic representation of a jacketed radiant heating tube with shut-off means in all medium inputs and outputs and an oxygen gas partial pressure detector in the exhaust gas stream for the performance of the process of the invention.

The following is a description of the process of the invention for the safety control of burner systems, in conjunction with the jacketed radiant heating tube diagrammatically represented in FIG. 1. In the following description, many special details, such as special shut-off means for the medium inputs and outputs of the radiant heating tube data on particular oxygen partial pressures and corresponding values of the detector output signal, are given for the purpose of facilitating comprehension of the process of the invention. It is clear to the person skilled in the art that the invention can nevertheless be practiced without such details. In other cases, known apparatus, including signal processing circuits, are not described in detail, so as not to encumber the invention with unnecessary details.

FIG. 1 shows a burner having a jacketed radiant heating tube 1, which has a central feed tube 2 for gas and a chamber 3 surrounding it for the delivery of combustion air. The combustion gas and the air are mixed in a burner mouth 4. The burner mouth 4 is adjoined by the combustion tube 5 in which the combustion takes place. The exhaust gases are returned in a reverse stream in a jacket 6 concentrically surrounding the combustion tube, and preheat the combustion air in the heat exchange section of the radiant heating tube 1 adjacent the annular chamber 3. In the exhaust gas stream (pipe section 7) of the jacketed radiant heating tube 1 there is disposed a detector 8 which responds to the oxygen gas partial pressure in the exhaust gas. Its electrical output signal (EMF) is determined in a controller 9 and is converted to a warning signal given by the acoustical alarm 10 and/or to one or more actuating signals to shut off the medium inputs and outputs.

In the case of the burner system shown in FIG. 1, a safety system is provided, consisting of a magnetic valve 13 and a mechanical limit switch 14 which detects the on and off positions of the magnetic gas valve 13. With the mechanical limit switch 14 there is connected a position feedback means 15 which converts the mechanically detected end position to an electrical signal and delivers it to the controller 9.

In the air feed duct 16 there is disposed an additional shut-off means in the form of a magnetic valve 17, and in the exhaust gas duct 18 there is disposed a shut-off means in the form of a magnetic valve 19. A manual shut-off valve 20 is placed ahead of the magnetic valve 13 and serves as a safety shut-off in the event of failure of the magnetic valve 13.

In the operation of the jacketed radiant heating tube 1 of FIG. 1, the oxygen partial pressure is continuously monitored by the detector 8 at relatively low exhaust gas temperatures down to 200° to 300° C. In the normal operating range represented in FIG. 2 (over-stoichiometric), the electrical output of the detector 8 varies but slightly, and the controller within this normal range of the output signal gives neither a warning signal nor an actuating signal to close the shut-off means. But when the combustion shifts out of the over-stoichiometric to the under-stoichiometric range, a great, abrupt change in the output signal results, as indicated by the broken curve in FIG. 2. This is definitely recognizable by the controller, even though the curve is relatively inconstant and cannot be evaluated quantitatively on account of the low exhaust gas temperatures. Such an abrupt change in the measuring sensor output signal is to be considered as an indication that the burner system—here the jacketed radiant heating tube 1—is operating under unfavorable combustion conditions or the flame has gone out, so that the appropriate maintenance measures must be taken by the operating personnel. The controller 9 produces a warning signal, for example through the acoustical alarm 10, or it produces an actuating signal for the immediate shut-off at least of the gas input by means of the magnetic valve 13.

The closed position of the magnetic valve 13 is confirmed to the controller 9 through the limit switch 14 and the end position detector circuit 15. If, while it is in this confirmed closed position, an output signal is given to the controller 9 through the measuring sensor 8 which exceeds a bottom limit value preset in the controller, a warning signal is given so that the hand shut-off valve 20 can be immediately closed. In this manner continuous surveillance can be exercised by means of the same oxygen partial pressure detector 8, even for leaks in the main shut-off means.

In the event of the irruption of a foreign gas into the jacketed radiant heating tube 1 from the exterior, there will likewise occur a clearly detectable shift of the signal from the detector 8. When such a shift occurs, all of the medium inputs and outputs connected to the jacketed radiant heating tube 1 are shut off by the magnetic valves 13, 17 and 19. In this manner, cracks in the jacket 6 can be detected relatively quickly and the necessary countermeasures can be initiated.

Figure 2:
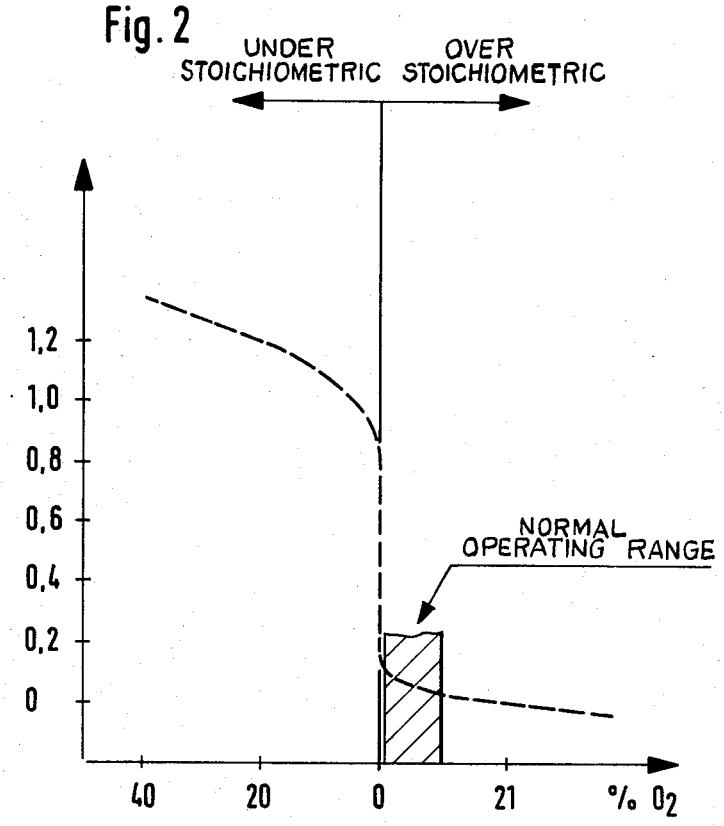
FIG. 2 is an exemplary response curve of a detector responding to oxygen partial pressure, the curve representing the change in the detector output signal versus the oxygen partial pressure in the over-stoichiometric and under-stoichiometric range.

A similar control is also possible in the case of jacketed radiant heating tubes or recuperatory burners which are operated under-stoichiometrically for the production of an inert gas, that is, those in which the normal operating range lies in the left portion of the curve shown in FIG. 2.

A process has been described which permits a simple, continuous safety surveillance of jacketed radiant heating tubes and recuperatory burners through the use of a detector responding to the oxygen partial pressure in the exhaust gas. Disturbances in the combustion ratios, or flame-outs while the gas feed is open, leaks in the closed magnetic gas valve, and defects such as cracks in the jacket of a jacketed radiant heating tube are reliably detected and actuating signals are produced for shutting off the inputs and outputs of the jacketed radiant heating tube or for giving an alarm.

I claim:

1. In a burner system containing at least one radiant heating tube to which combustible gas is fed through a gas feed line and combustion air is fed through an air feed line, wherein a safety circuit comprising a gas shut-off means and end position feedback means for confirming the open and closed positions of the gas shut-off means is associated with the gas feed line, a process for the surveillance of the combustion conditions in the radiant heating tube and for the detection of leakage of the gas shut-off means, said process containing the following steps:

(a) measuring the $O_2$ partial pressure in the exhaust gas stream at low exhaust gas temperature using a detector which responds to the $O_2$ partial pressure in the exhaust gas and produces an electrical output signal in accordance with the $O_2$ partial pressure, (b) closing the gas shut-off means and confirming the closed position by the end position feedback means, (c) producing a reference signal in accordance with the process step (b), (d) comparing the actual level of the detector output signal with a bottom limit value which is derived from the said reference signal, and (e) producing an alarm signal if the actual level of the detector output signal is above said bottom limit with the gas shut-off means closed.

2. Process of claim 1, wherein the gas shut-off means is actuated electromagnetically, wherein furthermore the position of the shut-off means is mechanically sensed by an end switch and the mechanically sensed end position is converted to an electrical signal, and wherein the electrical signal is transmitted to a controller for feedback of the end position.

3. In a burner system containing at least one radiant heating tube to which combustible gas is fed through a gas feed line and combustion air is fed through an air feed line, wherein the gas feed line is associated with a safety circuit comprising a gas shut-off means and end position feedback means for confirming the open and closed positions of the gas shut-off means, a process for the surveillance of the combustion conditions and of the flame in the radiant heating tube, said process containing the following steps:

(a) passing the exhaust gas stream through at least one heat exchange zone in which heat is withdrawn from the exhaust gas stream and the exhaust gas temperature during trouble-free operation of the radiant heating tube is reduced down to about 200° to 300° C., (b) measuring the $O_2$ partial pressure in the exhaust gas stream at the reduced exhaust gas temperature by using a detector which responds to the $O_2$ partial pressure in the exhaust gas and produces an electrical output signal in accordance with the $O_2$ partial pressure, (c) determining the occurrence of an abrupt change of said detector output signal due to the transition from overstoichiometric to under-stoichiometric combustion and vice-versa, and (d) producing an actuating signal for shutting off the gas feed to the radiant heating tube whenever said detector output signal departs from the preset range.

4. Process of claim 3, wherein the gas shut-off means is electromagnetically actuated, wherein furthermore the position of the shut-off means is mechanically sensed by an end switch and the mechanically sensed end position is converted into an electrical signal, and wherein the electrical signal is transmitted for feedback of the end position to a controller.

5. In a burner system comprising a burner, a recuperator integrated in said burner, a gas feed line for feeding combustion gas to said burner, an air fuel line for feeding combustion air to said burner, output means for outputting the exhaust gas stream from the recuperator, and shut-off means for closing at least said gas feed line, said integrated recuperator comprising at least one heat exchange zone for preheating the combustion air by the exhaust gas stream:

a process for the surveillance of combustion conditions in the burner system, comprising the steps of:

(a) passing the exhaust gas stream through said at least one heat exchange zone in said recuperator for withdrawing heat from the exhaust gas stream and reducing the exhaust gas temperature down to approximately 200° to 300° C.;

(b) measuring the oxygen gas partial pressure in the exhaust gas behind said at least one heat exchange zone at said reduced temperature with a detector which responds to the $O_2$ partial pressure in the exhaust gas and produces an output signal according to the $O_2$ partial pressure;

(c) determining the occurrence of an abrupt change in said detector output signal due to a transition from over-stoichiometric to under-stoichiometric combustion and vice versa; and (d) producing at least one actuating signal for actuating said shut-off means in response to said abrupt change in the detector output signal.

6. A process according to claim 5 wherein the recuperator includes a jacketed radiant heating tube, determining a shift of the detector output signal as a result of an ingress of foreign gas from the outside into the jacketed radiant heating tube, and actuating said shut-off means to close all said feed lines and exhaust gas output in response to said shift.

* * * * *